United States Patent [19]

Wajs et al.

[11] 4,364,785

[45] Dec. 21, 1982

[54] ASSOCIATION OF A PIECE OF FABRIC WITH A SHEET OF PVC

[76] Inventors: Michel Wajs; Helene Wajs, both of rue de Fiennes 61, 1070 Bruxelles, Belgium

[21] Appl. No.: 239,131

[22] Filed: Feb. 27, 1981

Related U.S. Application Data

[63] Continuation of Ser. No. 89,892, Oct. 31, 1979, abandoned.

[30] Foreign Application Priority Data

Oct. 11, 1979 [BE] Belgium ..... 197590

[51] Int. Cl.[3] ..... B32B 31/18; B32B 31/20

[52] U.S. Cl. ..... 156/88; 156/250; 156/251; 156/256; 156/267; 156/290; 156/308.4; 428/134; 428/286

[58] Field of Search ..... 156/88, 251, 267, 248, 156/250, 268, 290, 256, 308.4; 428/134, 286

[56] References Cited

U.S. PATENT DOCUMENTS

| | | | |
|---|---|---|---|
| 2,328,063 | 8/1943 | Dodge | 156/251 |
| 2,729,009 | 1/1956 | Markus et al. | 156/251 |
| 2,749,640 | 6/1956 | Scott | 156/251 |
| 2,804,419 | 8/1957 | DeWoskin et al. | 156/267 |

*Primary Examiner*—Michael G. Wityshyn

*Attorney, Agent, or Firm*—Robert E. Burns; Emmanuel J. Lobato; Bruce L. Adams

[57] ABSTRACT

The present invention relates to a process for making articles comprising an association, in a generally flat state, of a material having an entangled or interlaced texture, particularly a woven material or other fabric, the cut edges of which may per se unravel or undo or tend to unravel or undo, with a sheet of plastic material, such as polyvinylchloride (PVC), which is a macromolecular material lending itself to be cut and to present a clean edge . . . without any risk of unravelling or undoing.

3 Claims, 7 Drawing Figures

FIG. 1
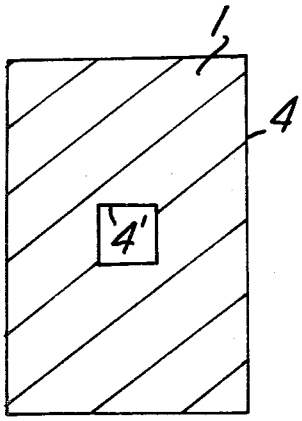
FIG. 2
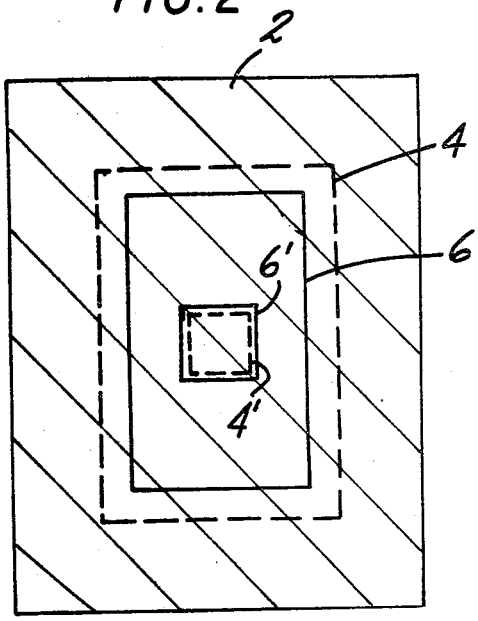
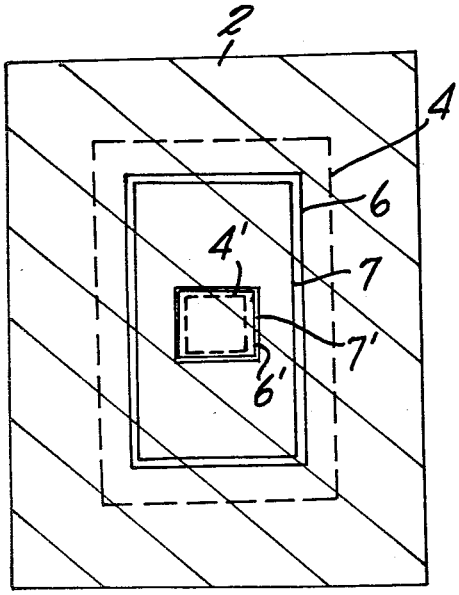
FIG. 3
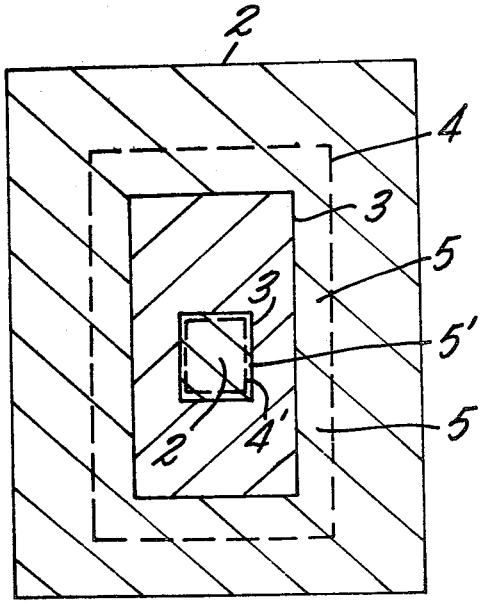
FIG. 4

FIG. 5
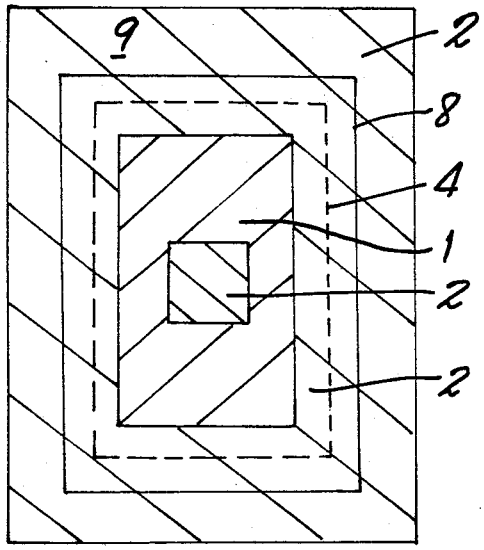
FIG. 7
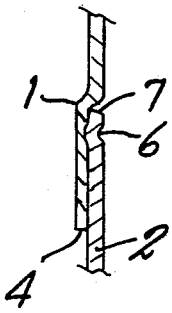
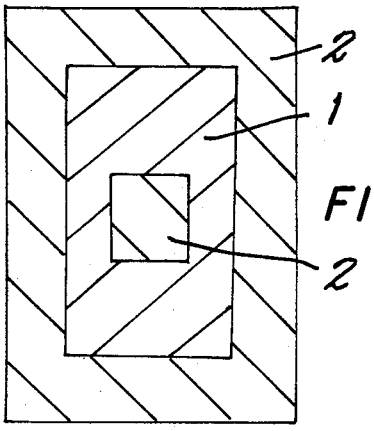
FIG. 6

ASSOCIATION OF A PIECE OF FABRIC WITH A SHEET OF PVC

This is a continuation, of application Ser. No. 89,892, filed 10/31/79, now abandoned.

BACKGROUND OF THE INVENTION

The present invention relates to a process for making articles comprising an association, in a generally flat state, of a material having an entangled or interlaced texture, particularly a woven material or other fabric, the cut edges of which may per se unravel or undo or tend to unravel or undo, with a sheet of plastic material, such as polyvinylchloride (PVC), which is a macromolecular material lending itself to be cut and to present a clean edge . . . without any risk of unravelling or undoing.

For making such articles—as, for example, in the marocco-leather manufacture of fancy articles, fabrics bordered with strips of PVC (replacing the leather previously used) have of course already been used, this to give a good definition to the edge of the fabric, and the borders made of PVC were (as before were the leather borders) fixed to the fabric by stitching, which process, as the gluing one, is expensive, gluing requiring moreover a very high precision.

The process in accordance with the present invention allows to avoid the above-mentioned drawbacks and to obtain in a quite rapid manner an association, in a generally flat state, of a material having an entangled or interlaced texture, particularly a woven material or other fabric, with a sheet of plastic material, such as polyvinylchloride (PVC) with perfectly clean and regular edges and lines of junction.

SUMMARY OF THE INVENTION

This process for associating a fabric or pieces of fabric with a sheet or parts of a sheet of PVC is characterized by the fact that the surface of at least one face of the fabric, and the entirety thereof, is covered with a PVC sheet that extends at least slightly beyond its whole contour, the fabric being as a rule previously cut at least slightly beyond the outer contour of the surface that will be visible or apparent in finished form, as well as cut eventually in the same way but at least slightly within the contour of the internal surface or surface of PVC that will be visible or apparent in finished form, which surfaces are then formed exclusively by the PVC sheet, the process comprising moreover the step of forming a line or strip of welding between the fabric and the superimposed sheet, near the edge of the outer contour of the fabric surface and near the edge of the contour beyond the surface or surfaces of PVC sheet that will eventually be internal in finished form, and the step of cutting at the same time or subsequently the PVC sheet, on the whole of its contour, within the peripheral line of the outer welding line or strip and beyond the peripheral line of the welding line or strip of the eventual inner part or parts of PVC sheet, all parts of the fabric that are to be visible or apparent in finished form being lastly uncovered by simply removing the corresponding parts of the PVC sheet.

Preferably, while the welding of the fabric and the PVC sheet together is carried out, the welding lines or strips of the eventually provided parts PVC on PVC may also be formed, as well as, at the same time as the already mentioned cutting line, the cutting line of the final contour of the PVC sheet, and this, also beyond the welding line or strip, the marginal parts in excess being also at last simply removed. An association of both materials in such a way as to obtain two visible or apparent faces of fabric is of course possible; in such a case, the fabric is covered on both sides with a sheet of PVC or it is inserted or sandwiched between both layers of a folded sheet of PVC.

BRIEF DESCRIPTION OF THE DRAWINGS

To provide a clearer understanding of the present invention, a description is given below with reference to the accompanying drawings, schematically illustrating, by way of non-limitative example only, the process in accordance with the invention.

In said drawings,

FIG. 1 is a plan view of a piece of fabric cut to the desired size;

FIG. 2 is a plan view of the PVC sheet, which represents the welding lines, the PVC sheet covering the piece of fabric visible in FIG. 1, which is shown in dashed lines;

FIG. 3 is a view similar to FIG. 2, but with the PVC sheet presenting moreover the inner cutting lines;

FIG. 4 is a view similar to FIG. 3, but the inner parts of the cut sheet having been removed;

FIG. 5 is a schematic view corresponding to FIG. 4, but showing also the cutting line of the outer contour of the sheet;

FIG. 6 is a view similar to FIG. 5, the marginal cut parts having been removed, and FIG. 7 is an enlarged fragmentary cross-sectional view showing the zone of superposition of the fabric and the PVC sheet.

DESCRIPTION OF THE PREFERRED EMBODIMENT

In the various figures of the drawings, a fabric is indicated by the reference numeral 1 and a sheet of polyvinylchloride (PVC), by the reference numeral 2; the contour line of that part of fabric 1 that will be visible or apparent in finished form is indicated by the reference numeral 3; the lines of the cutting contour of fabric 1, i.e. the outer peripheral line of cutting and that of an inner portion are respectively indicated by the reference numerals 4 and 4', while the marginal parts of the fabric 1 that will not be visible or apparent in finished form with respect to lines 4 and 4' respectively are indicated by the reference numerals 5 and 5'; the welding lines along which the fabric 1 and the PVC sheet 2 are fixed together with respect to the marginal parts 5 and 5' respectively are indicated by the reference numerals 6 and 6'; the inner cutting lines of the PVC sheet with respect to the welding lines 6 and 6' respectively are indicated by the reference numerals 7 and 7'; the cutting lines of the outer contour of the PVC sheet 2 are indicated by the reference numeral 8, and the marginal parts of the PVC sheet that are to be removed are indicated by the reference numeral 9.

As seen in FIGS. 1 to 4, the different steps of the process in accordance with the present invention consist of: first—FIG. 1—cutting the fabric 1 along lines 4 and 4'; second—FIG. 2—placing the PVC sheet 2 onto the fabric 1, the PVC sheet covering entirely the fabric and extending beyond the outer contour (cutting lines 4) of said fabric, and welding together the fabric 1 and the PVC sheet 2 along the lines 6 and 6', the welding line 6 being located within the cutting line 4 and the welding line 6′ being located outwardly of the line 4′ of the fabric 1; third—FIG. 3—cutting the PVC sheet 2 along inner cutting lines 7 and 7′, the cutting line 7 being located within the line 6 and consequently within the line 4 and the cutting line 7′ being located outwardly of the line 6′ and consequently outwardly of the line 4′; fourth—FIG. 4—removing the cut part of the PVC sheet, i.e. that part which is comprised between the cutting lines 7 and 7′.

In practice, after the PVC sheet 2 has been placed onto the fabric 1, the welding operation (along the lines 6 and 6′) and the cutting operation (along the lines 7 and 7′) are carried out at the same time by means of a welded press that is provided with cutters and that effects at a time, i.e. during one and the same stroke, the welding along the lines 6 and 6′ and the cutting along the lines 7 and 7′, and after having taken off the PVC sheet 2 and the fabric 1 from the press, one removes the cut part or parts of the PVC sheet 2 by tearing them away; the welding press (not shown) may also be used for jointly carrying out the operation of cutting the PVC sheet 2 at the desired size, i.e. it may also simultaneously cut the sheet along the cutting line 8 (FIG. 5), which will be located beyond the cutting line 4 of the fabric; the marginal part in excess, indicated by the reference numeral 9, is then removed. Moreover, in the case of a visible double face association (not shown in the drawings), in which case the fabric 1 is inserted or sandwiched between two PVC sheets 2, it is also possible to form, during one and the same stroke of the press, the welding lines or strips of each of both PVC sheets enclosing the fabric 1.

In order that the present invention may be more easily understood, the cutting lines 7 and 7′, in the various figures of the drawings, are represented at a distance from the welding lines 6 and 6′, that in practice will be more or less wide strips, at the close edge of which the cutting lines will as a general rule be located. On the other hand, in the considered example, it is provided that there will be in finished form an internally visible or apparent part of PVC; in such a case, the inner cutting along the line 4′ of the fabric 1 is not required, but it is shown in the drawings in order to indicate the exact locating of the inner welding and cutting lines.

The present invention is not of course limited to the embodiment described and illustrated and it would not be outside the scope of the invention to make modifications in this embodiment.

We claim:

1. In a process of making a composite article comprising a layer of fabric and a superposed layer of thermoplastic material, the combination of steps of:

cutting only said fabric to predetermined shape by cutting said fabric along an outer periphery and also along an inner periphery defining an opening in the fabric, placing on one side only of said fabric a sheet of said plastic material which completely covers said fabric and extends beyond all peripheral edges of said fabric, welding said plastic sheet to said fabric along a first weld line inwardly of the outer periphery of said fabric and along a second weld line adjacent but outwardly of said inner periphery of the fabric, cutting said plastic sheet along a first line inwardly of said first weld line and along a second line outwardly of said second weld line, removing that portion of said plastic sheet between said first and second cutting lines, and cutting said plastic sheet along a line outwardly of the outer periphery of said fabric to sever a marginal portion of said plastic sheet, and removing the severed marginal portion of said plastic sheet.

2. A process according to claim 1, in which said first weld line is spaced inwardly from the outer periphery of said fabric.

3. A process according to claim 1, in which said welding along said first and second weld lines and said cutting along said first and second cutting lines are done in a single operation.

* * * * *